United States Patent [19]

Thorne

[11] 4,428,284

[45] Jan. 31, 1984

[54] BAND AND HAMMER DOT MATRIX PRINTER

[75] Inventor: William D. Thorne, Wake Forest, N.C.

[73] Assignee: International Business Machines Corp., Armonk, N.Y.

[21] Appl. No.: 522,246

[22] Filed: Aug. 11, 1983

Related U.S. Application Data

[63] Continuation of Ser. No. 334,950, Dec. 28, 1981, abandoned.

[51] Int. Cl.[3] ..... B41J 3/12; B41J 1/20

[52] U.S. Cl. ..... 101/93.04; 101/93.14; 400/121; 400/146

[58] Field of Search ..... 400/121, 124, 146; 101/93.04, 93.05, 93.09, 93.14, 111

[56] References Cited

U.S. PATENT DOCUMENTS

| | | | |
|---|---|---|---|
| 3,667,384 | 6/1972 | Sniderman | 101/111 |
| 3,941,051 | 3/1976 | Barrus et al. | 101/93.04 |
| 3,960,074 | 6/1976 | Chon | 101/111 X |
| 4,127,334 | 11/1978 | Watanabe et al. | 400/320 X |

FOREIGN PATENT DOCUMENTS

| | | | |
|---|---|---|---|
| 2356839 | 5/1974 | Fed. Rep. of Germany . | |
| 2432499 | 1/1976 | Fed. Rep. of Germany . | |
| 2555865 | 6/1976 | Fed. Rep. of Germany . | |
| 2525528 | 12/1976 | Fed. Rep. of Germany | 400/121 |
| 7507826 | 1/1976 | Netherlands | 400/124 |
| 1470283 | 4/1977 | United Kingdom . | |

OTHER PUBLICATIONS

*IBM Tech. Disc. Bulletin,* Helinski et al., vol. 20, No. 9, Feb. 1978, pp. 3408, 101–111.

IBM, TDB, vol. 23, No. 4, Sep. 1980, pp. 1573–1574.

*Primary Examiner*—Paul T. Sewell

*Attorney, Agent, or Firm*—Edward H. Duffield

[57] ABSTRACT

Described, is a printing mechanism allowing full exploitation of the potential of dot matrix printing. Dot forming elements are mounted on a carrier for transport past an array of hammers located in front of media to be marked upon. The dots or carrier are impacted by the hammers to form dots on the medium. By appropriate control of motion of the printing medium and timing of the hammer impacts, a dot may be formed anywhere on the surface of the medium. This allows unlimited character font set generation as well as special character printing for enlarged font, miniaturized font, fast rough draft copy printing, the printing of ascenders and descenders for characters and for condensed or compacted printing. In addition, the mechanism permits an all points available graphics generation system and full control for variable vertical spacing of printed elements and of variable horizontal spacing of the printed elements. Variable print element shapes, grey tone graphics printing and multi-color additive or subtractive color processes are also facilitated.

2 Claims, 11 Drawing Figures

PRINTING 8 LINES PER INCH AT
100 X 67 PEL DOT SIZE EQUALS
.016 INCH DIAMETER

PRINTING 8 LINES PER INCH AT 90 X 96 PEL
DOT SIZE EQUALS .022 INCH DIAMETER

PRINTING 8 LINES PER INCH AT
90 x 96 PEL DOT SIZE - ELLIPTICAL

PRINTING 6 LINES PER INCH AT 90 x 72 PEL
DOT SIZE EQUAL .011 INCH DIAMETER

BAND AND HAMMER DOT MATRIX PRINTER

This is a continuation, of application Ser. No. 334,950 filed Dec. 28, 1981, now abandoned.

FIELD OF THE INVENTION

This invention relates to impact printing and matrix printing mechanisms and apparatus of the dot forming type in general. In particular it relates to the hammer and marking element type of printers of this class.

PRIOR ART

A variety of dot matrix printers are known in the prior art. For example, many so-called dot matrix print heads exist in which one or more wires or elongated dot forming elements may be projected forward under appropriate control to impact a ribbon and drive it against a medium to be marked upon. Appropriate systems for relative movement between the print head and the medium are known. Such general mechanisms of this class are numerous and have been widely adapted for use and currently enjoy a high level of success. These so-called wire matrix print heads and the mechanisms employed in them suffer, however, from many inherent difficulties. First, it is necessary to translate the entire print head back and forth along a line of printing or to move the paper in order to cause relative motion between the two to occur. Mechanisms for horizontal translation of print heads back and forth in a repetative and precisely controlled manner are expensive and relatively difficult to build and maintain. The mass of the number of hammers in the print head limits the through put due to the turnaround time required. A variety of problems can exist when such mechanisms are out of proper adjustment. Such problems may cause distortion of or failure to create the desired printed images. The general configuration uses a vertical array of print wires which limits the vertical dot placement and causes poor utilization of hammers dedicated to decenders. This also causes uneven wear of hammers due to usage. In addition, the failures of one or more wire elements may make themselves known by distortion of virtually all of the printed material which follows the failure. The inherent limitations of devices of this type include those of relatively limited speed of printing. Printing speeds in the range of only 80 to 300 characters per second with a single print head of this type are within the broad general bounds and limitations of the present technology of this sort.

Another general class of dot matrix printers comprises the so-called bar and helix or bar and element intersectional impact printers. In these devices, a moving raised ridge or print element passes behind a sheet of paper to be marked upon and is impacted by a hammer impacting the paper against element at a carefully controlling time to create a dot of the approximate size and shape of the intersectional area between the hammer and the print element. Such printers may be utilized either as serial character printers or line printers where a number of hammers may be simultaneously employed in creating dots for the formation of characters or images. In printers of this latter type, extremely accurate control of the timing of the hammer impact relative to the exact location of the moving print element must be maintained. A variety of designs exist and devices of this character have been widely used to good effect. However, numerous difficulties with this type of design do exist. For example, the print element character is often a precision machined metal drum with raised ridges upon it is used as one-half of the dot element intersection former device. The raised ridges must be very carefully spaced and dimensioned in profile in order to perform appropriately to provide high quality, carefully controlled placement of the resulting dot marks on the medium. Imaging and shadow printing occur with this technology. It limits the forms thickness and number of copies that can be made without distortion. The paper movement to cause printing produces accoustical noise which is difficult to suppress. Wear, misalignment and other mechanical and physical effects may cause rapid deterioration of the printing quality in such a system and the expense of the dot forming device is considerable. In addition, the shape of the dot produced is inherently limited to that of the intersection between the moving raised ridge and the hammer pace. These devices do offer generally higher printing speeds, however, and speeds in the range of 100 to 600 lines per minute may be generally attainable with this technology.

A specific example of this type is shown by U.S. Pat. No. 4,068,583 wherein the dot elements are formed at the intersection between a generally horizontal hammer and a generally vertical raised ridge or element carried on a belt or band. Appropriate paper and marking medium are interposed between the moving belt and a hammer and an impact between a raised ridge on the belt and the hammer creates an intersectional dot, a plurality of which may be created through appropriate timing of the hammer impacts with the moving belt and motion of the paper to form any desired characters. The shape and form of the resulting dots is, however, limited to the intersectional area between the moving print element and the face of the print hammer so that wear on one or more print hammers and/or print elements may be apparent in the resulting print quality of many print characters. This design, however, does avoid the use of an expensive drum carrying the raised print element ridges.

OBJECTS OF THE INVENTION

In view of the foregoing inherent difficulties or inadequacies in the known prior art, it is an object of this invention to provide an improved, more flexible and generally useful dot matrix printer which is both of relatively low cost and high speed and which does not suffer from the aforementioned difficulties to the extent or of the type noted.

It is a further object to provide an improved dot matrix printing technology which permits easy variation of the shape or form of the dots to be generated and which is compatible with the requirements of a variety of useful dot matrix printing features such as: unlimited character font sets, special character printing for enlarged font, miniature font, rough quality draft font, full ascender and decender capability, condensed or compacted printing, full all points available graphic display, full variable vertical and horizontal spacing of print elements and full variation of print element shape, grey tone graphic quality, dot location and which is effective for either multicolor additive or subtractive color printing techniques.

SUMMARY

The primary functional components for the dot matrix printer embodied according to the present invention are a movable print element carrier belt, which may be a continuous loop of material provided with fingers or other movable print elements each of which has two faces, and at least one print hammer. One face of the print element has a hammer impact face which may be struck by the print hammer. The other face of the element carries a dot or other form of raised character element forming shape. The movable print elements are located on a belt or band in such a fashion that any hammer actuator operation will contact only a single element and cause only that associated element to contact a ribbon to force it against the paper making a mark of the form of the dot or print element on the face of the element. The paper is supported by a platen and the appropriate controls for motion of the paper either in the vertical or horizontal direction are included. By appropriate timing of the impact between the moving print element carrier and the print hammers, a dot or mark of any desired shape according to the shapes provided on the moving band or belt can be formed anywhere on a fixed or moving sheet of paper.

BRIEF DESCRIPTION OF THE DRAWINGS

Turning to FIG. 1, a preferred embodiment of the present invention is shown in a pictorial and schematically representative form with the essential elements required being briefly depicted. In FIG. 1, the paper or media 1 to be marked upon is shown together with an appropriate platen 2 and a paper motion tractor or driver means 3 for moving paper 1 in the general direction of the arrow shown. Paper 1 may be moved either continuously or intermittently as is generally known in the art and it may be understood that the vertical spacing of the dot elements is primarily controlled by the degree of motion provided in indexing the paper from one dot row to the next and that spaces between characters in the vertical direction are created by advancing the paper further than for the formation of characters or for the formation of rows of dots to form characters. An appropriate ribbon 4 is interposed in front of the paper 1 and may be supported and driven by means not shown in FIG. 1.

Figure 1:
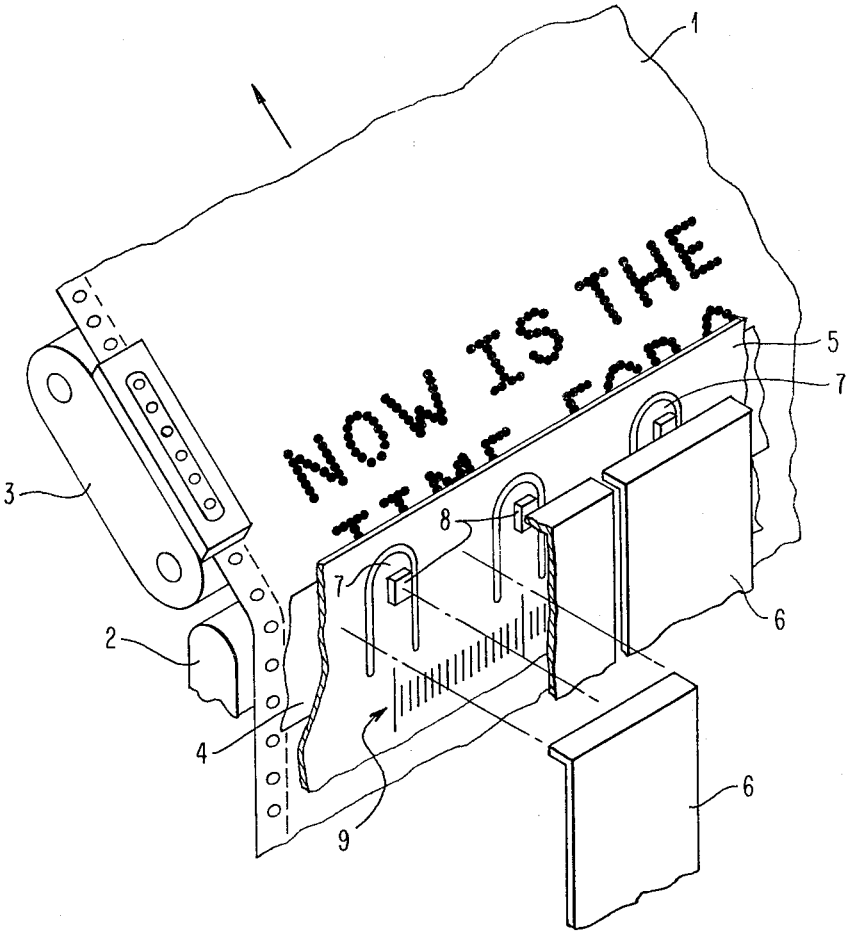
FIG. 1 illustrates the primary functional elements of a preferred embodiment of the present invention in a pictorial representation showing how they may be employed.

A movable belt or band 5 is one of the principle elements of the present invention and it is interposed in front of the ribbon 4 in a position separated from both the paper 1 and ribbon 4 and adjacent to, but separate from a bank of one or more impact hammers 6. The belt or band 5 may contain one or more print element dot forming means. These are generally shown as a movable or flexible finger 7 integrally formed with belt 5 and carrying an anvil or impact face on its backside shown as 8 in FIG. 1. The side of finger 7 (and of print element and anvil 8) facing paper 1 is not shown in FIG. 1. It will be understood to contain a raised projection in the appropriate plan or form to provide a dot of the desired shape on paper 1 when the anvil 8 may be struck by one of the hammers 6 to deflect the finger 7 and impact the print element against the ribbon 4 and paper 1.

As shown, each flexible finger 7 on the carrier belt 5 is integrally a part of band or belt 5 at the point of attachment at the base of each finger 7. Fingers 7 may also be non-integral with, but attached to, belt 5 by rivets or other suitable means. Also, as will appear later, the orientation of fingers 7 with respect to the line of tranvel of band 5 may be advantageously altered to reduce the possibility of snagging or catching an anvil 8 on the edge of a hammer 6.

A plurality of timing marks or slots 9 are shown on band 5. As is generally understood in the art, either optically transparent slots or magnetically or mechanically sensible marks may be made on a belt or band 5 in order to appropriately time the motion of the belt 5 past the hammer array 6.

As will be appreciated by those of skill in the art, the paper tractor or moving means 3 may take a variety of forms including friction wheel drive, reel-to-reel drive of a continuous paper form, perforated form tractor means such as shown schematically in FIG. 1 or suitable moving bed or platen drive means for advancing the paper. A variety of optical or mechanical emitters may be connected with the paper drive means to accurately gauge the degree of motion produced so that the vertical spacing of dot elements and characters eventually produced can be accurately controlled.

Similarly, the platen 2 will be understood to be schematic in representation only. Round or rotating platens of any desired material or shape can advantageously be employed according to the specific requirements of the paper medium 1 and the dot forming elements and ribbon elements. Likewise ribbon 4 may be an inked ribbon or a carbon film transfer type of ribbon or any of a variety of suitable ink or marking material carrying means for either additive or subtractive color formation. Ribbon 4 is indicated as generic in form only since it would be well understood in the art that numerous colors can be provided in bands or stripes on a given ribbon 4 and that various technologies for constructing a suitable ribbon 4 that provides the desired type of transfer of marking material to the surface of the paper by impact between them are known.

Figure 2:
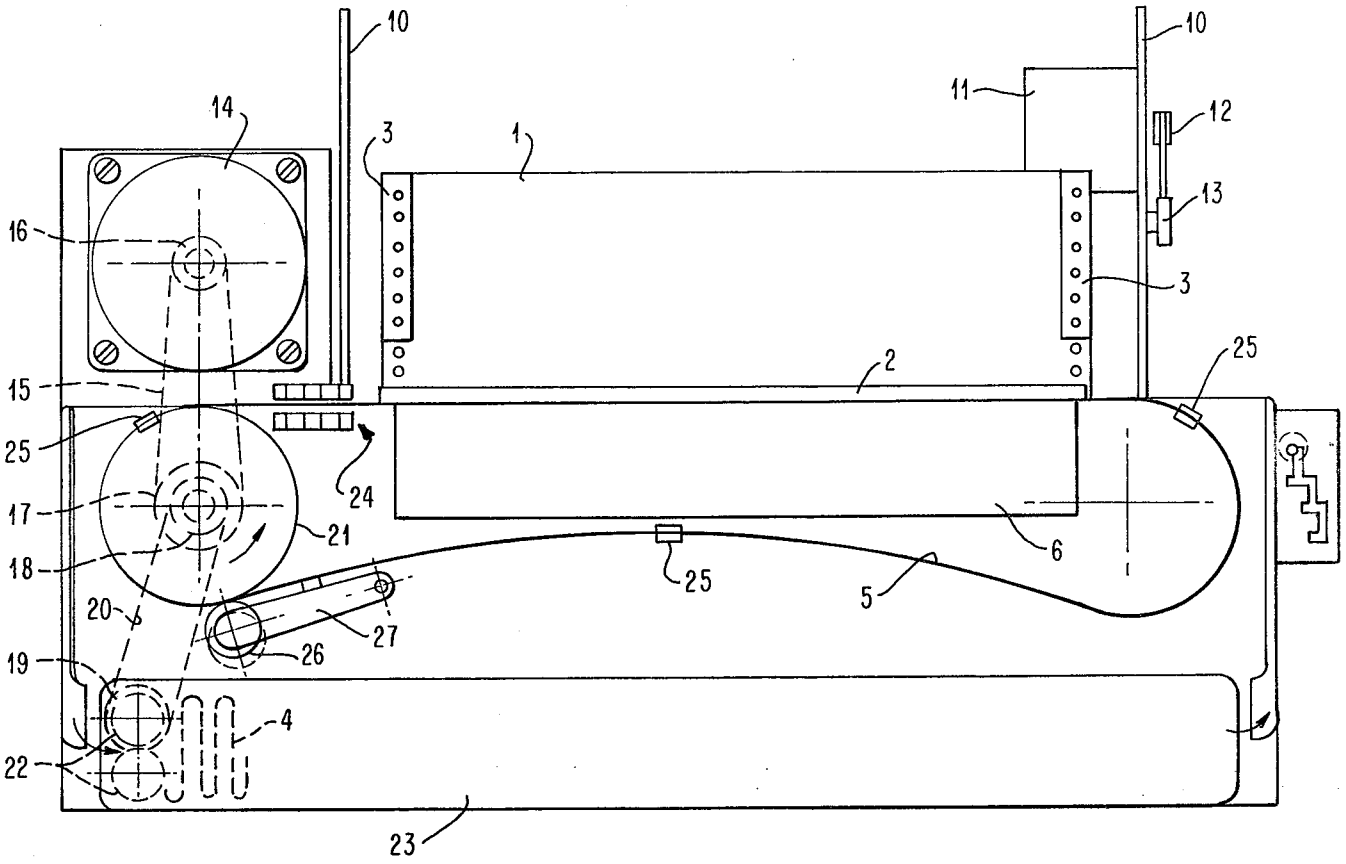
FIG. 2 illustrates a mechanically simplified plan view of a preferred form of the present invention of the general type shown in FIG. 1.

Turning to FIG. 2, a more detailed illustration of the overall embodiment partially shown in FIG. 1 is depicted. In plan view, FIG. 2 generally shows side frame members 10 between which are interposed a suitable platen 2 and form feed tractors or other paper loading means 3 for moving a paper 1 as shown. A paper or forms feed drive motor 11 for powering the paper moving means 3 through appropriate gear or belt means 12 and 13 may be utilized as shown. A connecting drive shaft for operating the sprockets in the form feed tractors of the type shown generally in FIGS. 1 and 2 is not illustrated in FIG. 2 but is understood by those of skill in the art. A bank of one or more hammers 6 is generally indicated as hammer bank 6. It is intended to encompass all of the individual hammers 6 that may be contained within it and is shown generally in FIG. 2 positioned on one side of the moving belt or band 5. The suitable marking ribbon 4 and paper 1 are interposed on the other side of the belt or band 5 with the paper 1 supported on a platen 2 as generally indicated.

A belt and ribbon drive motor 14 is generally indicated in FIG. 2 where a drive belt or chain 15 is connected between drive sprockets or pulley 16 mounted on motor 14 and an appropriate pulley hub 17 connected with the belt drive pulley or sprocket 21 as shown. The drive sprocket or pulley 17, 18 on drive wheel 21 may be compound so that a variation in the drive speeds between that of band 5 and the resulting speed of ribbon 4 may be achieved. Smaller diameter drive sprocket 18 is connected by a belt or chain 20 to a drive sprocket 19 for the purpose of driving frictional drive wheel 22. Drive wheel 22 engages ribbon 4 to draw it from the ribbon box 23 at its outlet as shown by the direction of the arrow at the right hand side of ribbon box 23. The drive also stuffs the ribbon back in at the left hand edge of ribbon box 23 as schematically illustrated by the serpentine loops formed in belt 4 within box 23.

An optical or magnetic position emitter sensor is generally shown in FIG. 2 with belt or band 5 passing between the two halves of the sensor 24. Sensor 24 may be either optical or magnetic and will operate based on the emitter markings or aperture 9 as shown in FIG. 1 which are placed on belt or band 5 as previously described. For example, if marks 9 on belt 5 are optically transmissive slots, sensor 24 may comprise a source of light and a photo cell interposed on opposite sides of the moving band or belt. This will produce electrical pulses varying in amplitude according to the presence of an optically transmissive or opaque portion of belt or band 5 passing through the sensor. The resulting electrical signal train may be appropriately shaped as a string of pulses to time or count. By this means the relative position of any of the movable print elements on the belt relative to some fixed position for the various print hammers 6 may be accurately defined.

Several vertical belt path positioners 25 are shown in FIG. 2. These may be understood to be guide means of an appropriate sort for maintaining the path for belt or band 5 in a precise vertical orientation as it tranverses the face of the paper 1 adjacent to platen 2. The drive wheel or pulley 21 for driving belt or band 5 is shown in FIG. 2. A pressure roller 26 mounted on an appropriate spring loaded or tension arm 27 is used to maintain an appropriate non-slip driving condition between pulley 21 and the belt or band 5. Sprocket wheel drives, or other suitable belt or band drive means including pinch rollers or direct motor drives may also be employed as will be understood by those of skill in the art.

Figure 3:
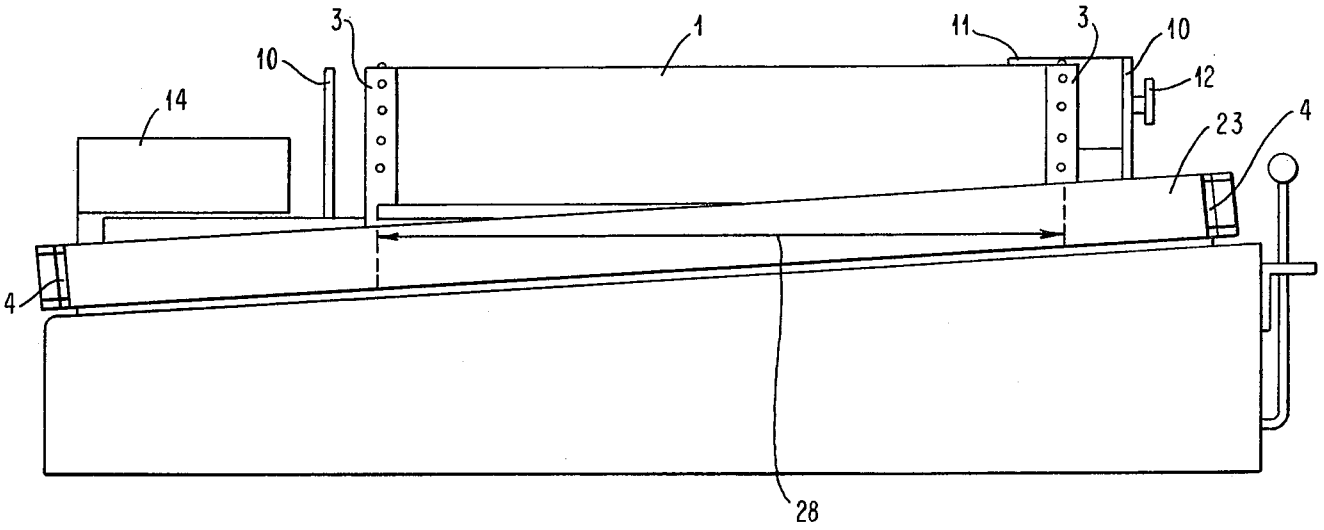
FIG. 3 is a front elevation view of the preferred embodiment shown in FIG. 2.

Turning to FIG. 3, a general front elevation view of the mechanism described in FIGS. 1 and 2 is illustrated. The print line 28 along which character elements are to be formed is schematically shown as the straight horizontal line 28 between the space encompassed by the two paper feed means 3. Other elements are the same as those depicted in FIGS. 1 and 2 and are similarly numbered. It will be noted that the ribbon box 23 together with the ribbon 4 is angled in the vertical direction with respect to the print line so that the full width of the ribbon 4 may be utilized. In general, angling of the printing ribbon with respect to the print line for this purpose is known in the art and is therefore shown in FIG. 3 as illustrative only of the principles employed.

Figure 4:
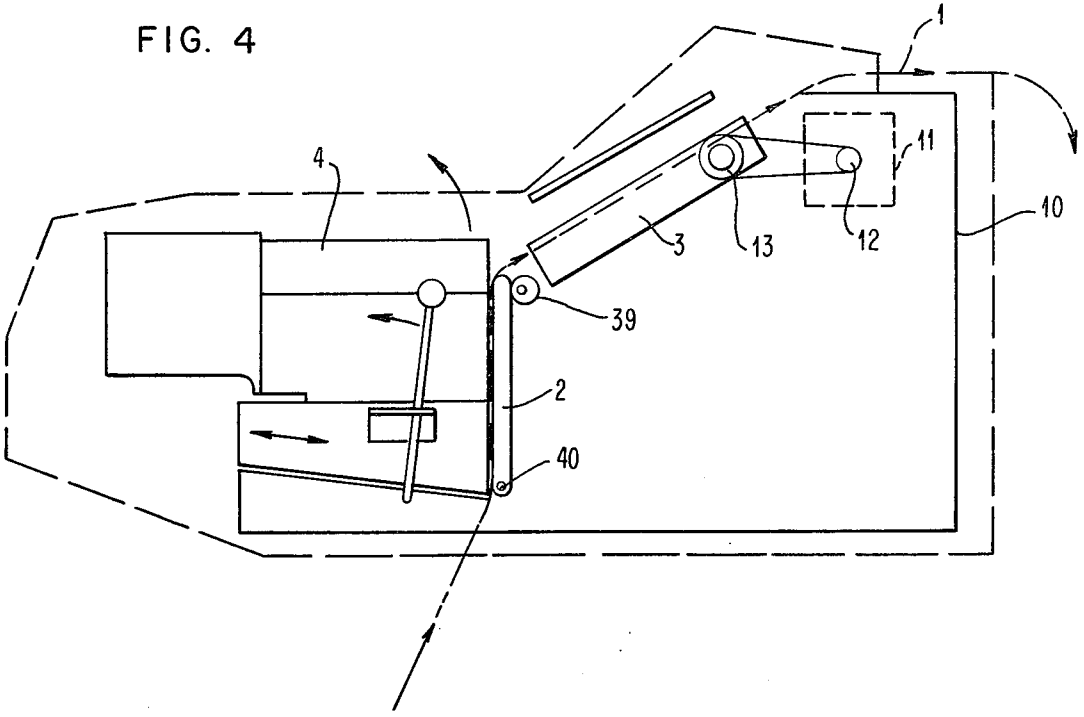
FIG. 4 is an end elevation view of the preferred form of the embodiment shown in FIG. 2.

As shown in FIG. 4, platen 2 may be pivoted at pivots 40 and located to bear against an eccentric 39, or other suitable equivalents, to vary the exact spacing between the dot elements on band 5 (not shown) and the surface of platen 2. This facilitates print force impression control for desired character quality or for multiple copy forms. Also, as may be appreciated here, it is not absolutely necessary to include a ribbon 4 if the media 1 is the pressure sensitive self-marking type.

Figure 6:
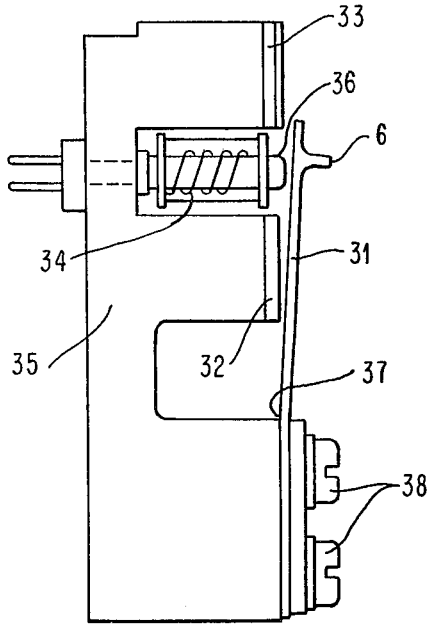
FIG. 6 illustrates a typical printing hammer of the sort used in the preferred embodiment of the invention.

As shown in FIG. 6, a number of hammers 6 may be provided. It will be understood by those skilled in the art that their form, structure and mode of operation may be of any convenient type. It is anticipated that each hammer 6 of the most preferred embodiment will utilize permanent magnets 31, 33, 35 that pull a leaf spring actuator 31 for each hammer 6 into a cocked position against core 36. Release of the cocked spring 31 is accomplished by energizing an electrical coil 34. Coil 34 is polarized oppositely to the permanent magnets. This negates the magnetic field of the permanent magnet and releases the cocked spring actuator to allow the hammer 6 to fly forward and impact the anvil 8 on the backside of each print finger 7 carrying the dot element 30. De-energization of the cancellation coil 34 allows a re-establishment of the magnetic flux field and a recocking of the leaf spring actuator 31. As shown, spring 31 is attached to the main magnet armature 35 by suitable screws 38 which secure spring 31 to resist bending stresses about fulcrum point 37 during cocking of spring 31. Such mechanisms are generally known in the art and need no further description here as their structure forms no part of the present invention.

A printing operation generally as depicted in FIG. 1 is performed as follows:

For maximum throughput, it is desirable that there be as many print hammers 6 as there are print element fingers 7 across the length of the print line 28 on paper 1. At appropriate positions across the length of the print line 28, the individual hammer actuators 6 will be caused to operate as previously described to impact the anvil surfaces 8. This will be done at appropriate individual timings to create a series of dots along the print line 28 at the appropriate spacing for partial creation or completion of one or more desired characters or shapes. It will be understood that the dots that are created will be in the exact form and shape of the faces of dot print elements 30 on the opposite sides of the anvil faces 8.

The width of the individual hammers 6 is conveniently chosen to be an integral number of character widths, at least one, and perhaps 2 or more to reduce the expense of hammer mechanisms. It will be understood that the number of hammers 6 will be dependent upon the repetition rate at which the individual hammers may be operated and upon the general throughput of printing that is required.

The translational velocity with which belt or band 5 is driven and which controls the rate of movement of the print elements across the print line is dependent upon the hammer impact repetition rate and upon the print element spacing desired on the resulting image.

When all of the desired print positions along a given print row in the print line have been provided and each of the print hammers has been fired at the appropriate number of times and places to create the dots, paper 1 will be moved to the next desired row position and the printing operation will be repeated. It will be understood that the operations can cause any print format to be printed under program control and that the vertical printed element spacing can be controlled by the degrees of rotation of the paper feed motor or mechanism (not shown in FIG. 1).

Figure 5A:
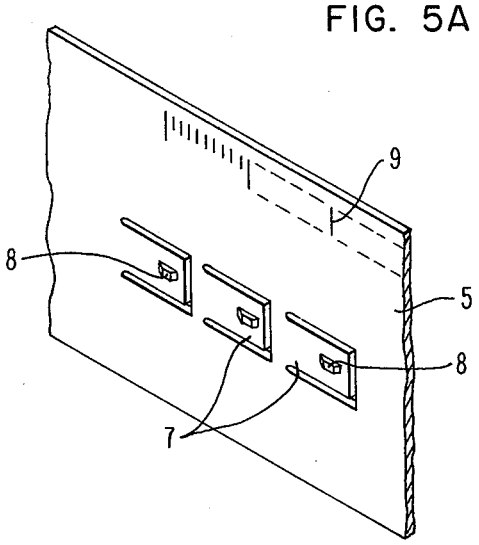
FIG. 5A illustrates an oblique view of the preferred form of a printing dot carrier belt.
Figure 5B:
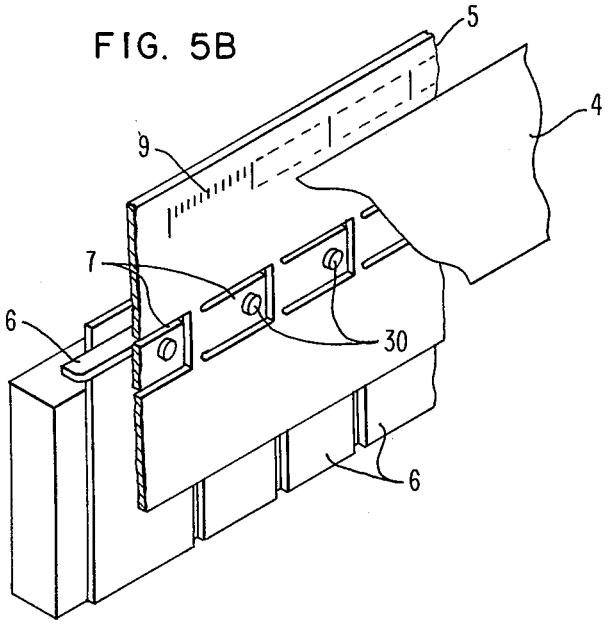
FIG. 5B illustrates an oblique view of the opposite side of the belt shown in FIG. 5A.

Turning to FIGS. 5A and 5B, an alternative form of a print belt or band 5 is illustrated in greater detail in a pictorial view. It may be appreciated that by a quick interchange of printing belts or bands 5, provision may be made for an individual user or customer to change either or both the shape or size of the dot elements utilized in the printer. Also printing belts or bands 5 of this type will not be as expensive or complex as printing drums or other precision formed devices generally used in the art. For example, if large character printing is desired, the use of a dot print element having larger diameter dots, for example 0.025" diameter dots, can be employed. However, when, contrary to this requirement, high quality printing with very close dot spacing is required, a dot element of approximately 0.010" in diameter could be utilized at 0.005" spacing in both the horizontal and vertical directions to create a high density image in which the individual dots will partially overlap one another.

The benefits in the two examples given will be instantly apparent since enlarged printing can be accomplished with equivalent print density and appearance in the same manner as normal printing and with few, if any, more printing strokes being required. This will maintain both the throughput and hammer and ribbon lives. However, improved quality printing would be impractical with large dot sizes and hence, the selection of a belt or band with smaller dots on it would be appropriate.

Appearance improvement in the resulting characters can be created also by adjusting both horizontal and vertical spacings of the print elements as controlled by varying the timing and degree of motion of paper movement and timing of hammer impacts. For example, vertical spacing of 0.01" and horizontal spacing of 0.02" as used in some alphanumeric formats may have its appearance improved if the print elements are made oblong and approximately of the same general dimensions of 0.01" by 0.02". Equivalent to this would be the multiple impact of a smaller dot at each of two adjacent locations to partially overlap and create the appearance of an oblong dot, but this would greatly reduce throughput since perhaps double the number of hammer strikes would be required.

It will be readily appreciated that the print belt 5 could be mounted within a cartridge system to provide for a clean hands changing of the belt and for identification of the belt contained within it. Also, such cartridges may carry mechanical or electrical encoding means on them to inform a using system by actual insertion of the cartridge into it as to which type of programming or which type of dot elements are carried within it.

In FIGS. 5A and 5B, the belt or band 5 may be conveniently made of steel or stainless steel. Typical specifications are that the band be approximately 0.005" thick and approximately 1–2" wide (or wider as desired). The fingers 7 are integrally formed by machining, stamping or etching them to leave base portions attached to belt 5 as shown. These carrier fingers 7 are designed to travel with their base attachment portions preceding the dot elements in the direction of travel in order to minimize the posibility of a hammer 6 being caught on the edge of an anvil 8, and to take advantage of any aerodynamic forces which will tend to keep fingers 7 in the plane of the belt 5. Radiused ends on fingers 7, sloped faces on anvils 8 and the means of attaching dot elements 30 to fingers 7 opposite anvils 8 are all obvious to one of skill in the art as shown in the figures.

Flexible or spring fingers 7 formed in the belt or band 5 may have the individual pairs of anvil 8 and dot forming elements 30 connected to them through an aperture (not shown). They may be staked and swaged in place or welded as the case may be.

Throughput calculations for typical performance of the subject invention are determined as follows. The data required for computing the throughput is that the hammer repetition rate, band dot pitch or element to element spacing on the band, the desired printed dot pitch on paper and the paper motion time to index from row to row. A formula for throughput in lines per minute can be expressed as follows:

$$\frac{\text{BAND DOT PITCH}}{\text{BAND SPEED}} \times \frac{\text{\# DOT ROWS}}{\text{PRINTED LINE}} + \text{PAPER MOTION TIME} = \text{LINE PRINT TIME} \qquad \text{(F. \#1)}$$

$$\text{FOR } LPM = \frac{60}{\text{LINE PRINT TIME}} = \text{LINES PER MINUTE}$$

For example, assuming that printing in an alphanumeric character set is utilized and that each of the hammers 6 spans two character positions and the intervening space between two adjacent characters, and utilizing a seven dot high by four, five, six, or seven dot wide character matrix with the following assumptions: hammer impact repetition rate is one millisecond, the band dot pitch is 0.2" plus an additional 0.04" of spacing to prevent contact of two adjacent anvils by a single hammer, desired print dot pitch of 0.02" and assumed paper indexing or motion time of 5 milliseconds per dot row and the band speed is as given by formula #2

$$\text{BAND SPEED} = \frac{\text{PRINTED DOT PITCH}}{HAM\ RR} \qquad \text{(F. \#2)}$$

where Ham RR stands for "hammer repetition rate" The result will be approximately 20" per second under the present assumptions. The total paper motion time for each line of print will be approximately 45 milliseconds and it will be observed that under these circumstances a throughput of 465 lines per minute will be easily obtained.

It will be instantly appreciated that the resulting throughput of printing will vary based upon the desired printing density of dots as controlled by the horizontal and vertical indexing or spacing of the individual dots and by the consideration of the number of dot rows included in each line of printed characters. For example, if there are 12 dot rows in each line and the band speed is approximately ½ the previous example rate in order to create double density in the horizontal direction, the horizontal print element spacing will be 0.01" and the resulting throughput will be approximately 172 lines per minute. Further decreases in throughput result as the horizontal print elements per line increase. Effectively, the number of hammer strikes required to generate all the dots on a given horizontal line are the controlling factor. As will be understood by those of skill in the art, if additive or subtractive color printing is required where individual dots of different colors must be overlaid, the effect will be approximately the same as generating higher density character formation by having more numerous hammer strikes in each horizontal line.

Figure 7A:
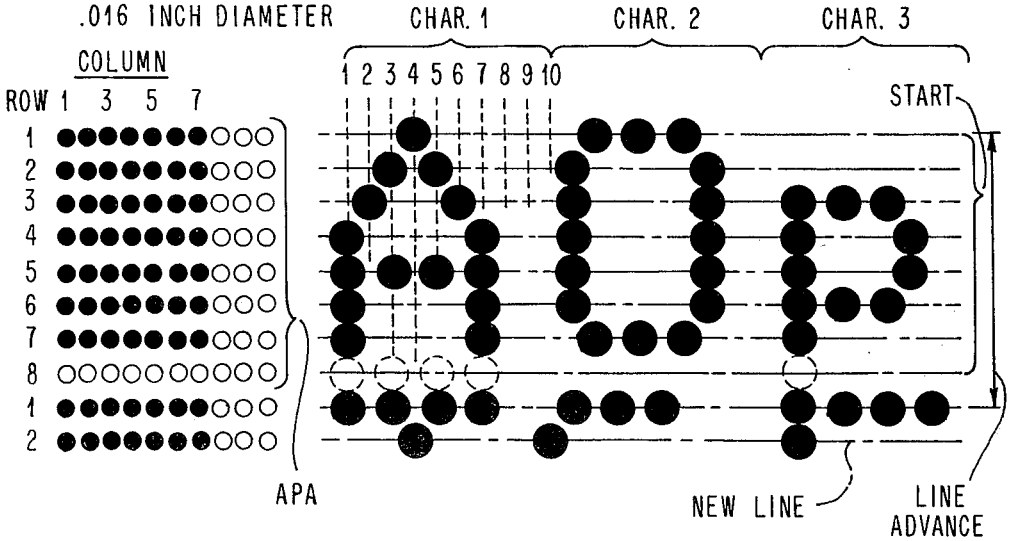
FIGS. 7A through 7D graphically depict some of the effects of varying the print element dot size and spacing.
Figure 7B:
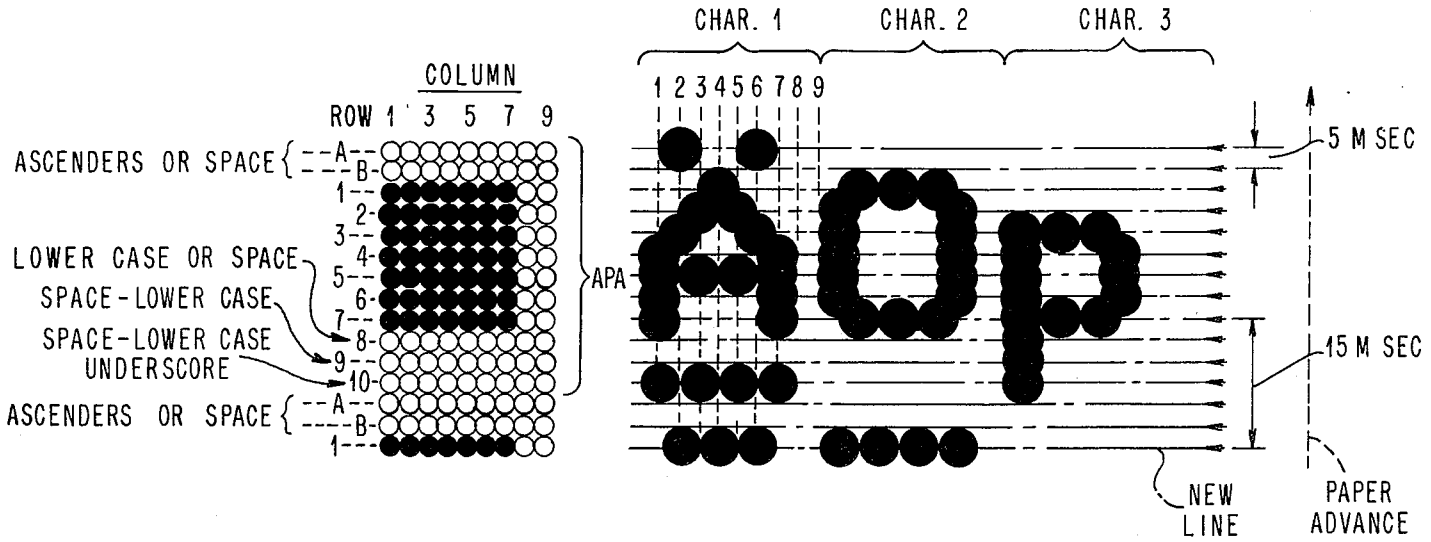

In FIGS. 7A–7D, some effects of varying the print element dot size and spacing may be observed. FIG. 7A illustrates a typical example of dot matrix printing using a conventional dot matrix printing head. FIG. 7B illustrates the appearance which is possible using larger dots as described for the present invention. Notice that both vertical and horizontal overlapping results which cannot be obtained in the conventional printhead method without having a reduced throughput due to additional passes to complete the characters after a partial row spacing by vertical paper movement.

Figure 7C:
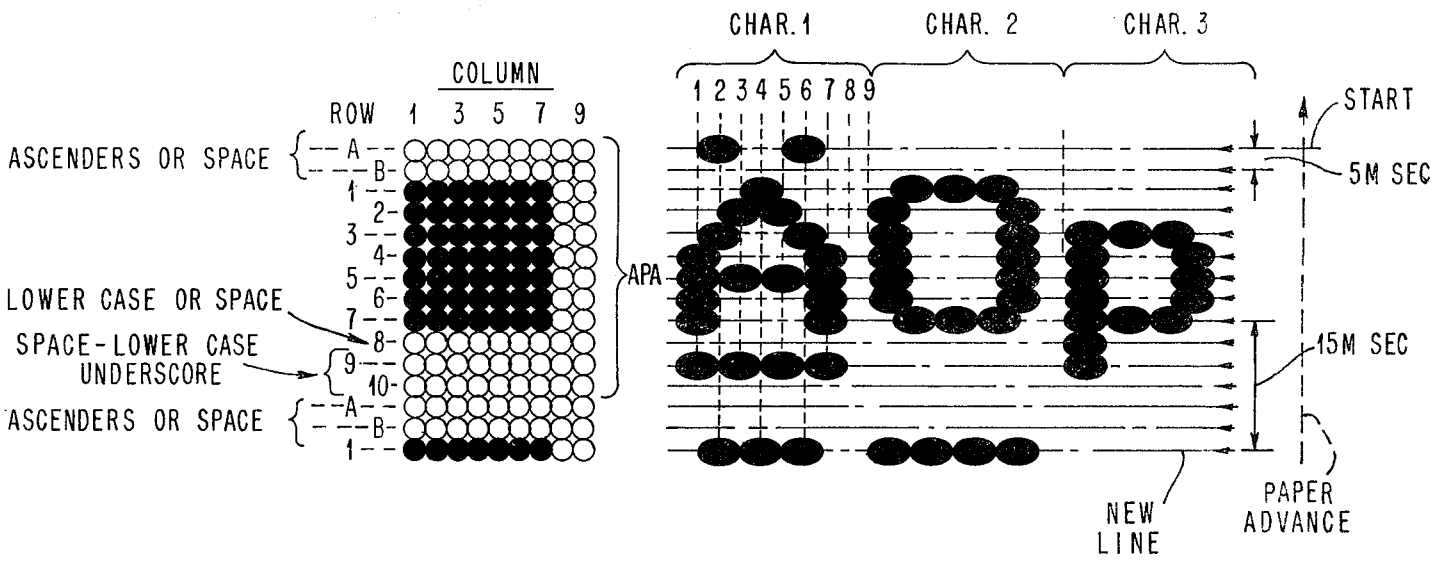

FIG. 7C illustrates the appearance possible in the finished results using the present invention with elliptical dot elements. Notice that either or both vertical and horizontal overlapping can be accomplished.

Figure 7D:
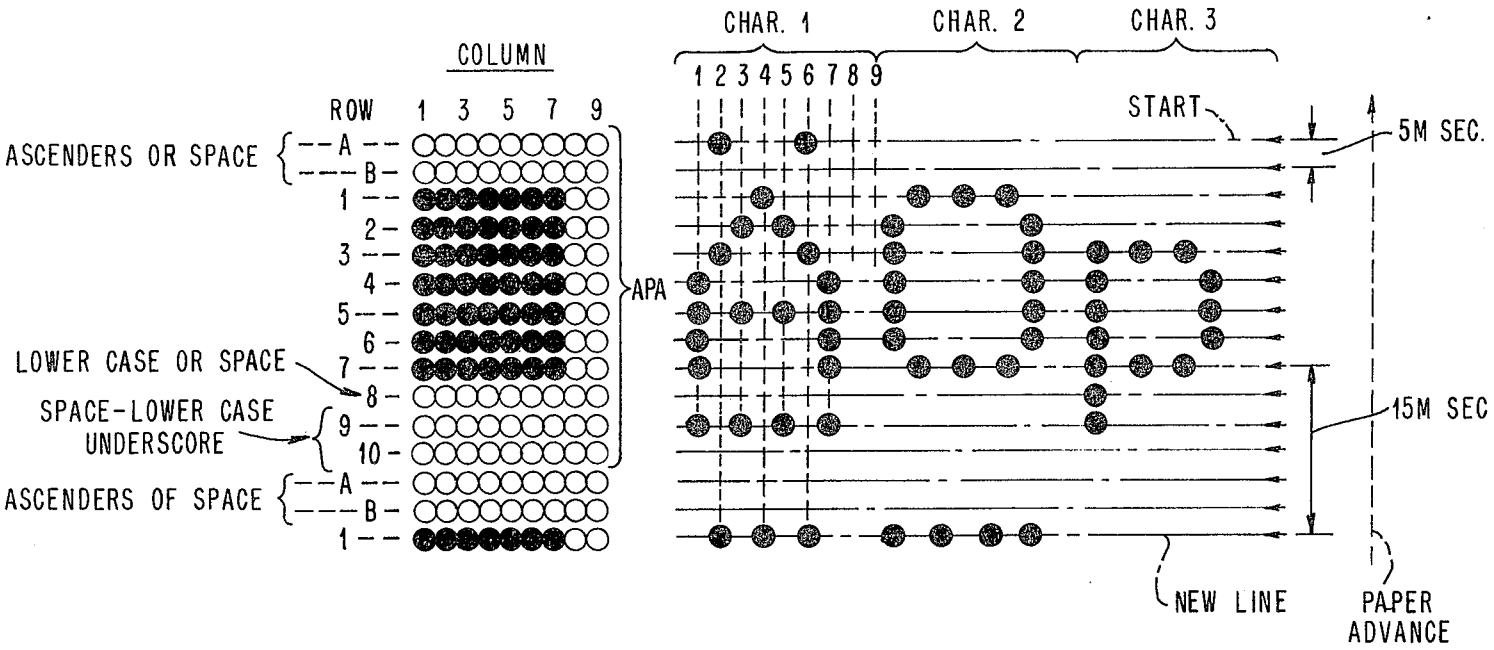

FIG. 7D illustrates another possible character font generated by using smalled dot elements than those in FIG. 7B.

The examples given are illustrative only. It will be apparent to those of skill in the art how easily and with what flexibility a wide variety of font appearances may be generated using this technology. Obviously an infinite variation of dot element face geometries exist. Circular, elliptical, rhomboidal, hexagonal or any other shapes could be used or even intermixed on the same belt for varying effects.

Having thus described my invention, what I claim as new and desire to secure by Letters Patent is:

1. A dot matrix printing apparatus for printing dots on a recording paper along a desired printing line, comprising:

a platen and a recording paper, said platen supporting one surface of said paper at least along said desired printing line;

a dot font element carrier adjacent to the side of said paper opposite to said platen and generally parallel thereto, said carrier extending parallel to said printing line;

a plurality of dot font elements connected to said carrier on a surface thereof facing said paper, all of said dot font elements being colinearly spaced apart from each other by at least a first width measured along parallel to said printing line and formed into a single line extending along said printing line;

a driving means engaging said font element carrier for moving said carrier at a predetermined velocity in a direction parallel to said platen and to said printing line to cause said carrier and said dot font elements to travel along said printing line;

at least one stationary impact hammer means adjacent to said dot font element carrier and so positioned that said dot font element carrier passes between said impact hammer means and said platen, said hammer having an impact face of a second width measured along said printing line which is at least an integral number of widths of dot printer elements, said second width being less than said first width of spacing between said adjacent font elements on said carrier;

hammer actuating means connected to said hammer means for actuating said hammer means to impact a portion of the surface of said carrier opposite to the surface of said carrier on which said dot font elements are connected, said impact driving at least a portion of said carrier and said dot font elements thereon toward said recording paper;

timing means connected to said hammer actuating means for timing said actuation to impact said carrier when said font elements thereon are adjacent to portions of said printing line where printed dots are desired; and means for shifting said paper in a direction orthogonal to said printing line and in the plane of said printing line to position a new portion of said paper on said platen along said printing line so that selected dots are printed in successive lines on said paper with a selectable spacing between successive lines in order to form a required dot matrix.

2. Apparatus as described in claim 1 wherein:

said dot font elements are attached to flexible spring members affixed to said carrier, each of said flexible spring members having a base portion affixed to said carrier and an elongated portion extending from said base, the distal end of said elongated portion being freely movable from the approximate plane of said carrier by flexure of said spring member along its axis from said base, and said flexible spring members being oriented relative to the direction of motion of said carrier so that said bases of said spring members precede said elongated portions thereof in the direction of travel of said carrier.

* * * * *